US006526922B2

(12) United States Patent
Jekerle

(10) Patent No.: US 6,526,922 B2
(45) Date of Patent: Mar. 4, 2003

(54) STEAM GENERATOR

(75) Inventor: Jiri Jekerle, Baunatal (DE)

(73) Assignee: Alstom Power Energy Recovery GmbH, Kassel (DE)

( * ) Notice: Subject to any disclaimer, the term of this patent is extended or adjusted under 35 U.S.C. 154(b) by 0 days.

(21) Appl. No.: 10/119,137

(22) Filed: Apr. 9, 2002

(65) Prior Publication Data

US 2002/0144663 A1 Oct. 10, 2002

(30) Foreign Application Priority Data

Apr. 10, 2001 (DE) ..... 101 17 989

(51) Int. Cl.[7] ..... F22D 7/00

(52) U.S. Cl. ..... 122/406.3; 122/489; 122/406.1

(58) Field of Search ..... 122/406.3, 411, 122/406.2, 468, 459, 460, 470, 489, 118, 410, 7 R, 406.1

(56) References Cited

U.S. PATENT DOCUMENTS 3,769,941 A * 11/1973 Dolezal ..... 122/406.1
5,575,244 A * 11/1996 Dethier ..... 122/406.1

* cited by examiner

*Primary Examiner*—Gregory A. Wilson
(74) *Attorney, Agent, or Firm*—Alix, Yale & Ristas, LLP

(57) ABSTRACT

A steam generator for converting water to steam by the transfer of heat from a heating medium includes two or more water/steam circuits. Each water/steam circuit has at least one evaporator for transferring the heat from the heating medium to the water. A single water/steam drum receives steam or water and steam from the evaporators. A descending pipe has at least one bypass, from which the supply pipes of the respective water/steam circuits branch off, and a venturi device in the area of the bypass. The inlet opening of the supply pipe of at least one water/steam circuit is disposed in the area of diffuser-shaped outlet of the venturi device such that the supply pipe section acts as a dynamic compression pipe in order to increase the pressure of the working medium in this circuit.

6 Claims, 7 Drawing Sheets

STEAM GENERATOR

STEAM GENERATOR

BACKGROUND OF THE INVENTION

This invention relates generally to steam generators. More particularly, the present invention relates to waste-heat steam generators or boilers which are heated by means of hot exhaust gases.

Such steam generators are primarily fed with hot exhaust gases from energy and/or process technology systems, and they often comprise a plurality of water-side pipe sections or circuits that not only have varying geometries but also have widely divergent heat capacities. For this reason, it is often necessary to control the distribution of the circulating water to individual pipe sections or circuits, for example with the aid of flow restrictors.

In the case of prior-art mechanically-circulated steam generators, the distribution of the circulating water to individual water-side pipe sections is controlled by means of orifice restrictors installed at the inlet to the individual heating surface coils or pipe sections (La Mont system). The pressure difference caused by the individual pipe sections and the orifice restrictors must be overcome with the aid of a circulating pump.

Controlling the circulating water in a gravity-circulation steam generator is a difficult problem since these steam generators generally lack sufficient pressure difference to allow orifice restrictors to be installed. The available pressure difference in the individual pipe sections or circuits is predetermined by the intensity of heating, the height difference and the pressure loss in the individual pipe sections. In this case, the installation of nozzle or orifice restrictors to improve the distribution of water is based on the idea of restricting the flow of water in the pipe sections that have good circulation in order to increase the circulation of water in the low-circulation pipe sections by means of a lower frictional pressure loss in the common descending and ascending lines. The total rate of circulation in the system is often greatly reduced in a disadvantageous manner, and only a modest improvement can be achieved for the affected pipe section-in other words, the weakly circulating pipe section.

SUMMARY OF THE INVENTION

The object of the invention is to provide a steam generator in which the water circulation in the individual pipe sections/circuits can be distributed more effectively without having a significant adverse effect on the total water circulation rate in the system.

The solution offered by the invention provides a steam generator that has the following advantages. It can distribute the water circulation rates in each pipe section or circuit as needed by increasing the pressure in the pipe section or sections in which an increase in the circulation rate is necessary or desired, without causing an additional pressure loss due to friction in the pipe section which does not require a pressure increase-in other words this measure can a) compensate for the lack of upward flow in a pipe section or in a plurality of pipe sections, b) more successfully overcome an inherently high pressure loss in a pipe section so that it is more closely matched to the other pipe sections or is matched to them as completely as possible, c) supply an evaporator device that is located within a steam generator and that has relatively high cooling requirements-for example, an end plate or a tube plate in a firetube boiler-with a relatively high quantity of cooling water, d) the pressure increase in the pipe section or in the pipe sections in which an increase in the circulation rate is required can be achieved without the use of an additional pump.

In a preferred embodiment of the invention, the venturi device comprises a venturi nozzle inserted in the descending pipe of a water/steam circuit. This makes it easy to configure the descending pipe with a standardized, commercially available nozzle, for example an EN ISO 5167-1 venturi nozzle.

In a preferred embodiment of the invention, the venturi device comprises a descending pipe line in the form of a venturi pipe. Thus, the venturi device is completely integrated in the descending line, and, if desired, it can be made of the same material and from a single piece.

Preferably, the steam generator of the invention is operated under natural convection flow. In this mode, one or more water/steam circuits that, for various reasons, has/have a weaker rate of circulation compared to a different or additional circuits can be operated at an increased water circulation rate without having to resort to additional pumps and consequently increasing capital spending, operating, and maintenance costs.

It is also advantageous to operate the steam generator of the invention with forced circulation. In this mode, one or more water/steam circuits that, for various reasons has/have a weaker rate of circulation compared to a different or additional circuits, can be operated at an increased water circulation rate.

In one preferred embodiment of the invention, the ratio of the inside diameter d of the venturi nozzle device at its narrowest cross section to the inside diameter D of the descending pipe is between 1.0 and 0.01. This embodiment ensures that the effect of an increased water flow rate is established in the circuit whose inlet is located in the diffuser-shaped outlet of the venturi nozzle device. Examples of the invention are illustrated in greater detail below based on the drawings and the description.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
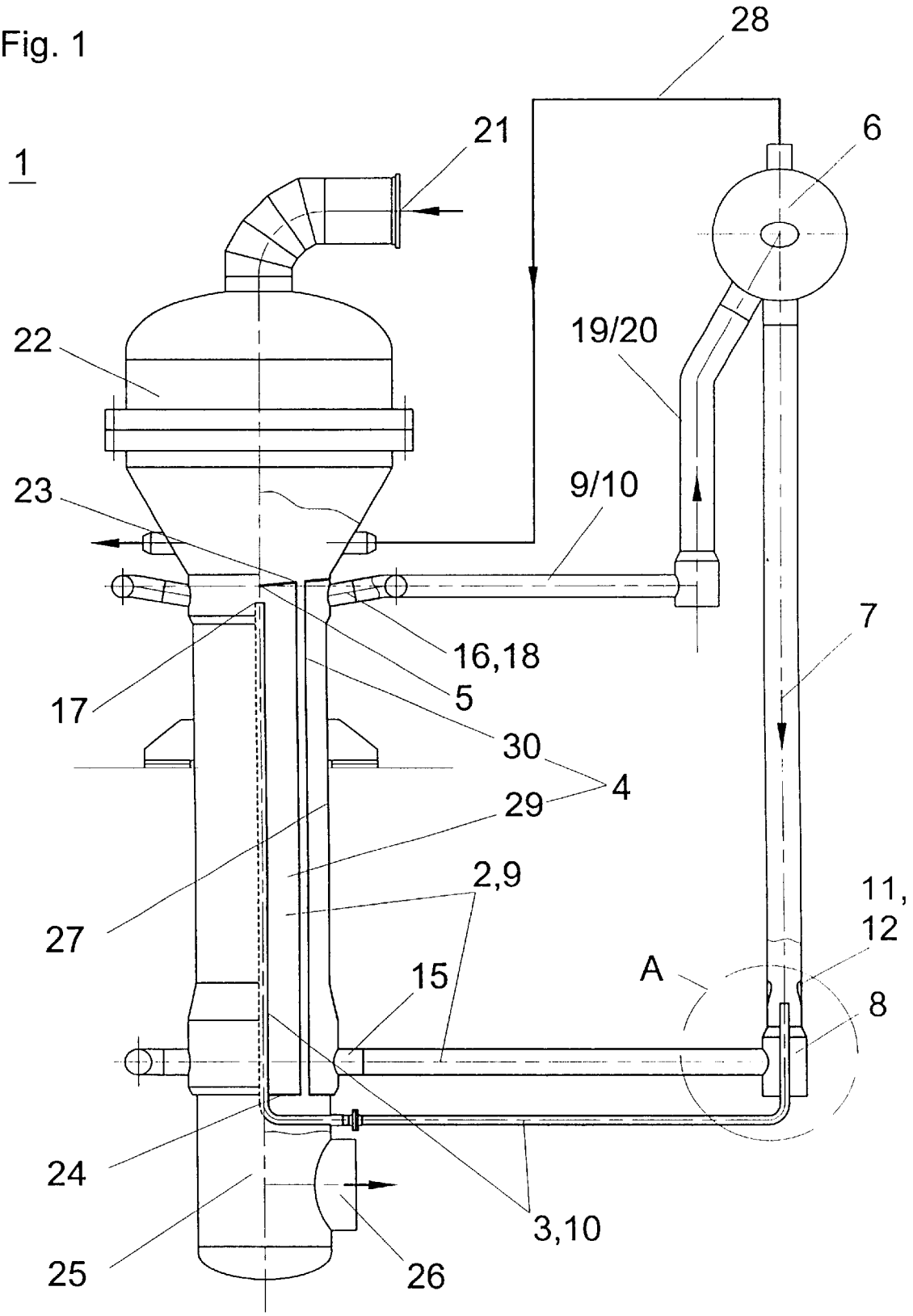
FIG. 1 is a schematic diagram in side view and partially in longitudinal cross-sectional view of a waste-heat steam generator in the form of a firetube boiler.

FIG. 1 shows a steam generator 1, embodied as a firetube boiler. It represents a waste-heat steam generator. The steam generator 1 essentially comprises a vertically disposed water space 29, which is laterally limited by a jacket 27 and by end or tube plates 23, 24 on the top and bottom. The water space 29 has at least one bundle of firetubes 30 passing through it that are disposed between the end plated 23 and 24 in a gas-tight manner and essentially are oriented in a vertical direction. The heating medium or hot exhaust gas that is needed to heat the water located in the water space 29 is supplied to the steam generator 1 via an inlet 21 and the gas inlet chamber 22. From the inlet chamber 22, the heating gas travels to the firetubes 30 that extend through the water space 29, and in the process transfers heat to the water located in the water space 29. Then the cooled heating medium passes through the gas outlet chamber 25 into the outlet 26, from where it can be routed to additional process steps, which are not shown. FIG. 1 shows how the hot exhaust gas travels from the top to the bottom through the steam generator 1. Depending on requirements, it can also travel from the bottom to the top. The water space 29 together with the firetube bundle 30 and both of the two plates 23, 24 comprise the evaporator device 4 of the first water/steam circuit 2.

The steam generator 1 shown in FIG. 1 has two water/steam circuits or pipe sections, 2, 3. From the water/steam drum 6, which is supplied with feedwater through a line that is not shown, the water travels through a common descending pipe 7, which extends away from the drum 6 and is designed in an essentially vertical orientation. This occurs via the bypass 8 into the two water/steam circuits 2, 3. The pipe section 9 that extends from the bypass 8 and is part of the first circuit 2 conveys the water through the inlet 15, which is located in the immediate vicinity of the lower end plate 24, into the water space 29. The water or steam, which is flowing upward as a result of heating and the resulting buoyancy, is directed in the area of the upper end plate 23 through the outlet 16 out of the water space 29 and is fed to the drum 6 via pipe section 9 and ascending pipe 19. Steam that has already been generated can be supplied from the drum 6 by means of a line 28 to a superheater (not shown) in the steam generator 1, or it can be sent elsewhere for a different purpose. The un-evaporated water from the drum 6 is routed back into circuits 2, 3 via the descending line 7.

Figure 2:
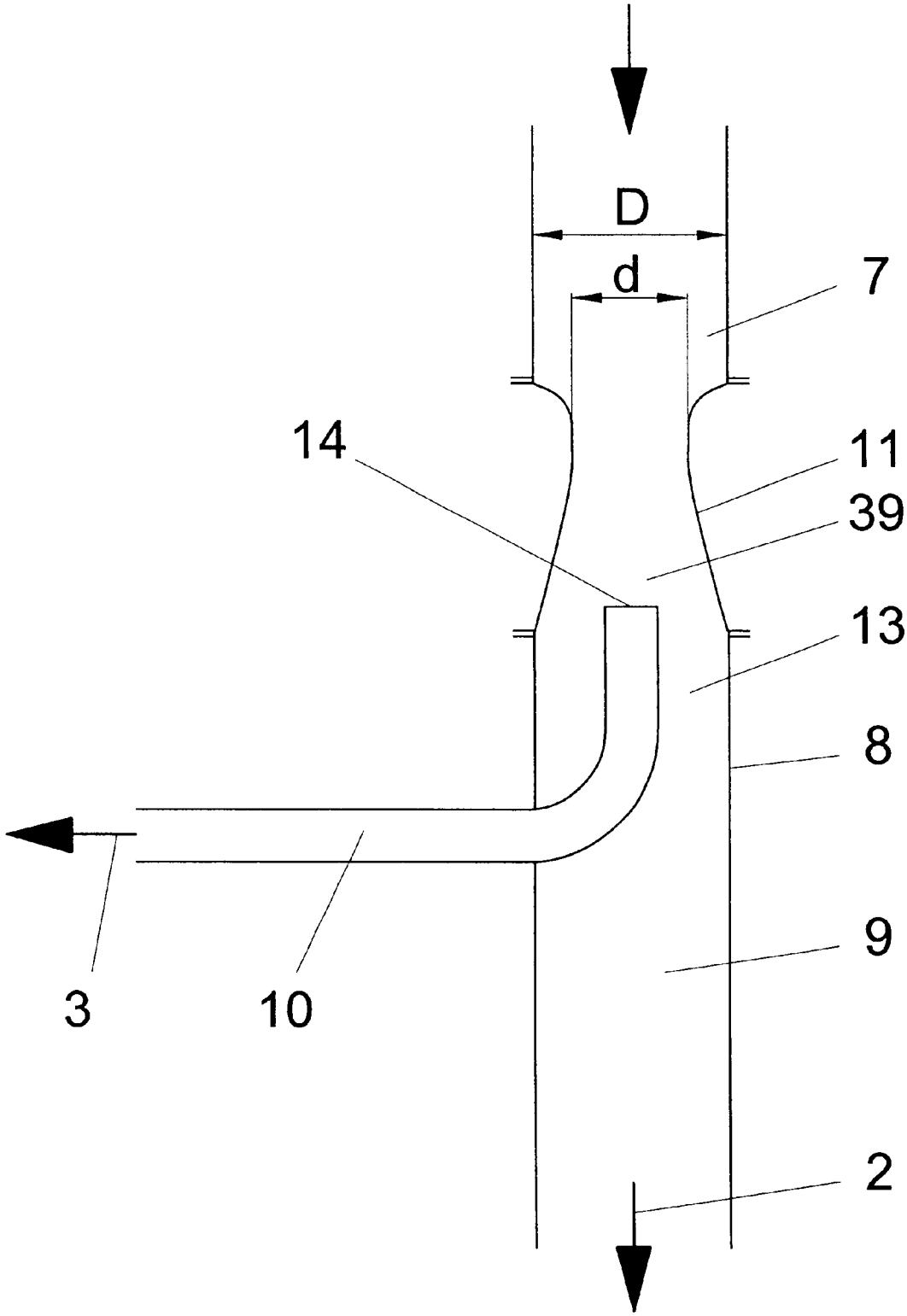
FIG. 2 is an enlarged schematic diagram of a first embodiment of a bypass having two pipe sections, according to Detail A of FIG. 1.
Figure 3:
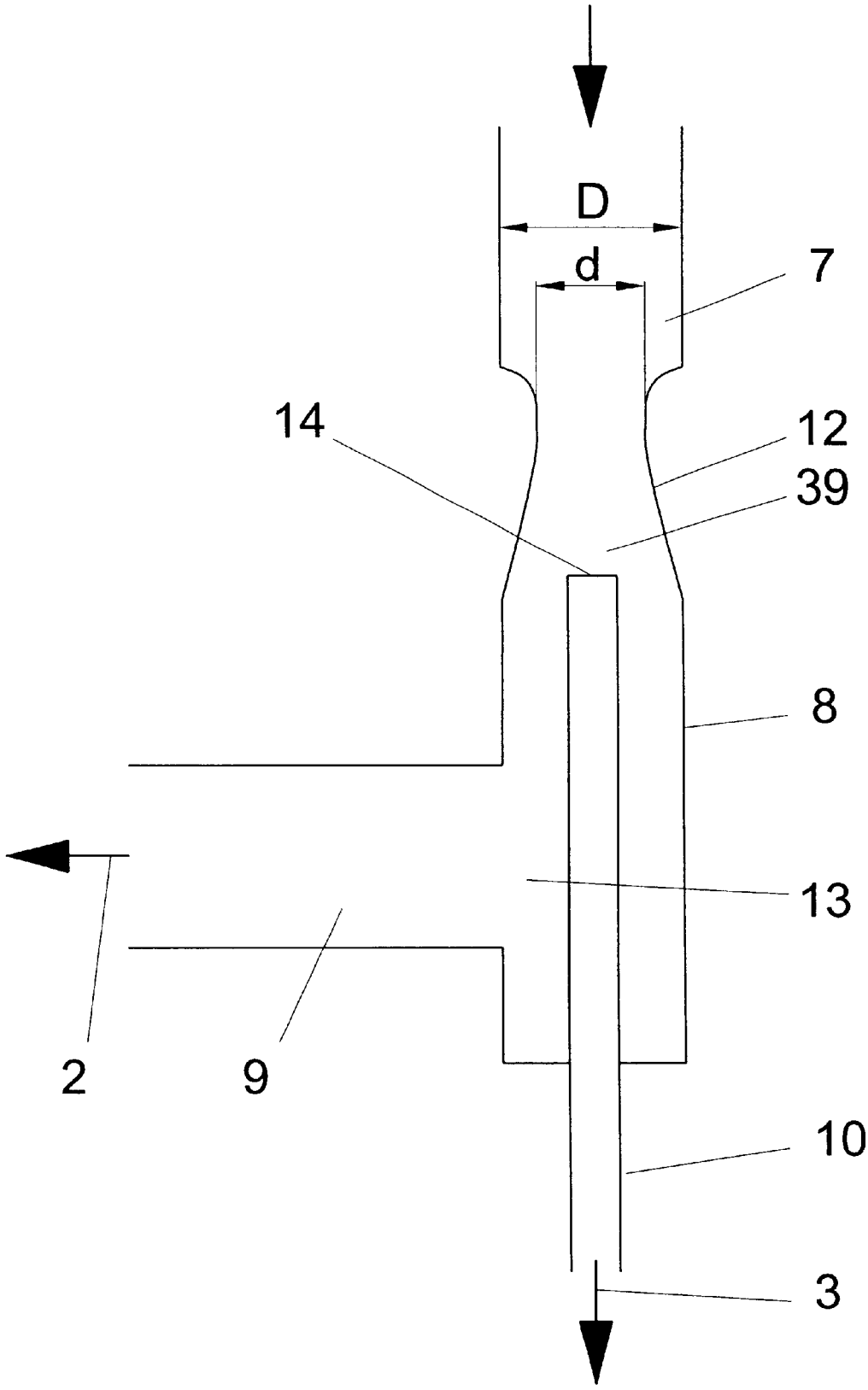
FIG. 3 is an enlarged schematic diagram of a second embodiment of a bypass having two pipe sections, according to Detail A of FIG. 1.

The pipe section 10 that leads away from the bypass 8 and that is part of the second water/steam circuit 3 shown in FIGS. 1 to 3 is embodied in the invention in such a way that the inlet opening 14 of pipe section 10 is disposed just downstream from the narrowest cross section of the venturi device 11, 12-in other words, in the area of the diffuser-shaped outlet 39 and in the middle of the descending line 7, and pipe section 10 is embodied as a dynamic pressure pipe. When pipe section 9 continues axially as shown in FIG. 2, pipe section 10 is advantageously routed away in a direction that is essentially perpendicular to line 9. As a result of the dynamic pressure of the flowing fluid caused by the venturi device 11, 12, the apparatus of the invention causes a pressure increase at the inlet 14 of the second circuit 3 or of pipe section 10, in that the water throughput is systematically adjusted to a higher level. The venturi device 11, 1 2 either comprises a standard venturi nozzle 11 that has a shape that is favorable to flow, for example DIN EN ISO 5167-1 with a specified diameter (FIG. 2) or a descending pipe 7 in the shape of a venturi tube 12 (FIG. 3), in which the static pressure of the fluid is restored when the cross section increases. The flow velocity, and thus the dynamic pressure upstream from the pipe section 10 that is embodied as a dynamic pressure pipe, is increased with the aid of the venturi device 11, 12. The high flow velocity is reduced again in the diffuser 39 of the venturi device 11, 12, and the static pressure increases. The increased dynamic pressure at inlet 14 in the second water/steam circuit 3 therefore is only produced by the conversion of the kinetic energy of the flowing medium in descending pipe 7 without causing an additional frictional pressure loss as a result of a restriction in the first water/steam circuit 2 or in the inlet 13 to pipe section 9.

The apparatus of the invention therefore causes a pressure increase to occur in the second circuit 3, without the need for an additional pump. In the present example, the upward flow of the gravity convection circulation system is optimally used for adjusting the desired water distribution within water/steam circuits 2, 3 of steam generator 1. The water flow rate that is now increased in the second circuit 3 is transported by pipe section 10 into the water space 29 of the steam generator 1 in such a way that pipe 10 terminates in a centered position relative to tube plate 23 directly below tube plate 23, and the water is forced from below against tube plate 23, which is heated to an especially great extent by the heating medium that enters the inlet chamber 22. This measure is able to reliably cool tube plate 23, which is threatened by high thermal loads, and the production of steam in the steam generator 1 can be maintained without interruptions or relatively frequent maintenance intervals.

After the water leaves pipe section 10 of the second circuit 3 and enters the water space 29 through the water chamber inlet 17 and after it in some cases has partially evaporated, the water/steam mixture, together with the water/steam mixture from the first circuit 2, flows through the water chamber outlet 16, 18 via pipe section 9 and ascending pipe 19 into the drum 6. The evaporator device 5 of the second circuit 3 essentially comprises the water space 29 and the upper tube plate 23.

However, pipe section 10 of the second circuit 3 can also be routed away from the venturi device 11, 12-in other words, in the axial direction of descending pipe 7. In this case, pipe section 9 of the first water/steam circuit 2 is generally routed away perpendicular to descending pipe 7.

Thus, the two circuits 2, 3 are brought together in the water space 29 in the steam generator shown in FIG. 1, and, by means of a shared outlet 16, 18 of a shared outlet pipe 9, 10, 19, 20 are fed into the drum 6. However, if the two circuits 2, 3 are not brought together (in other words, circuits 2, 3 each have separate evaporators 4, 5), the respective circuits can also be routed to the drum 6 by means of separate outlets 16, 18 as well as pipe sections and ascending pipes 9, 19 and 10, 20.

Figure 4:
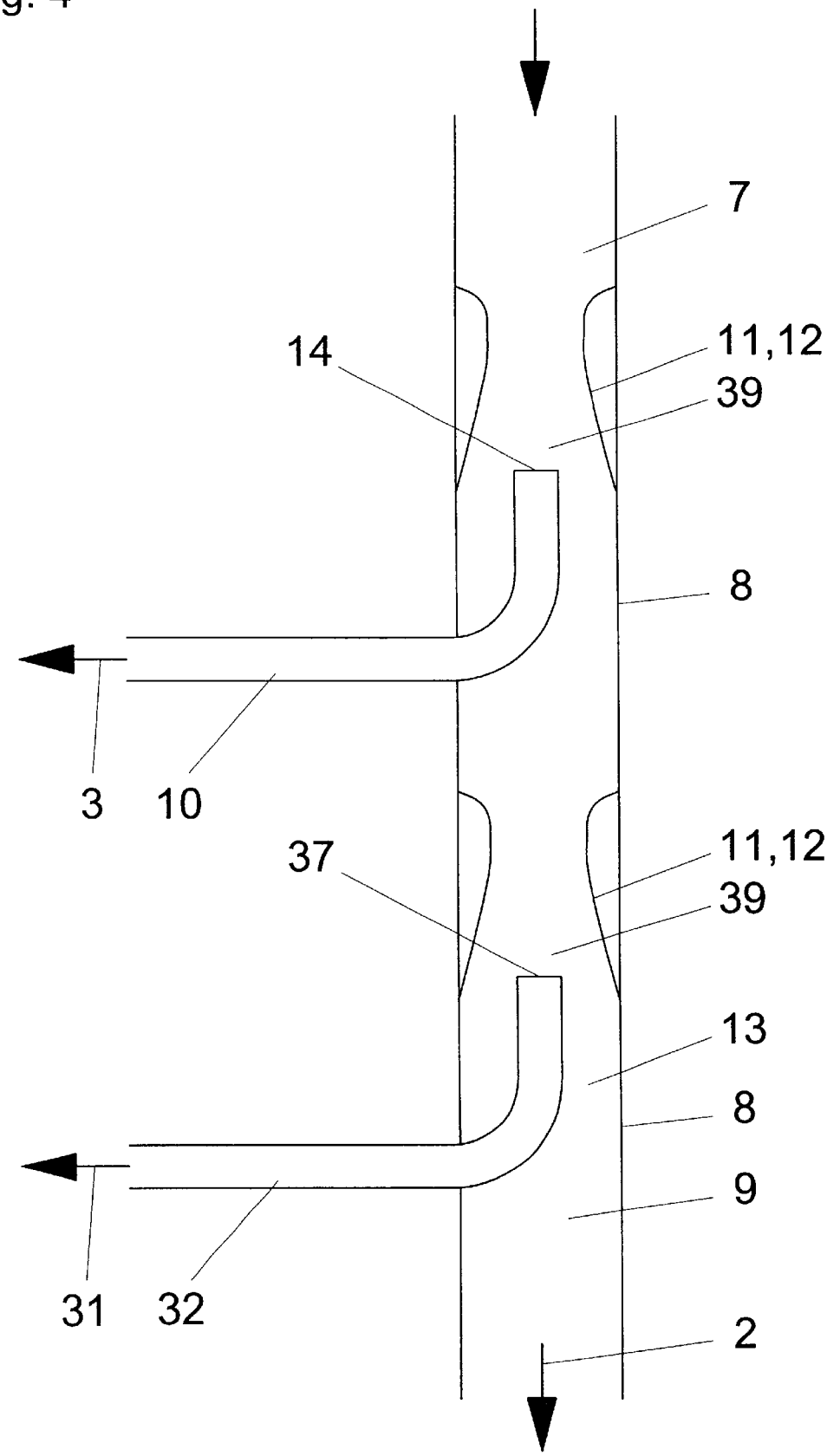
FIG. 4 is an enlarged schematic diagram of a first embodiment of a bypass having more than two pipe sections, according to Detail A of FIG. 1.

If there are more than two circuits within a steam generator 1, FIG. 4 shows that two or more bypasses 8 disposed following one another in the direction of flow in descending pipe 7, each equipped with a venturi device 11, 12, can be disposed in descending pipe 7.

FIG. 4 shows, in addition to the two circuits 2, 3, a third water/steam circuit 31 which, like the second circuit 3, experiences an increased water circulation rate. The working medium enters the third pipe section 32 through inlet opening 37 in the area of the diffuser 39 on the second bypass 8, and it is sent to a third evaporator device so that pipe section 32 can carry it to the drum 6.

Figure 5:
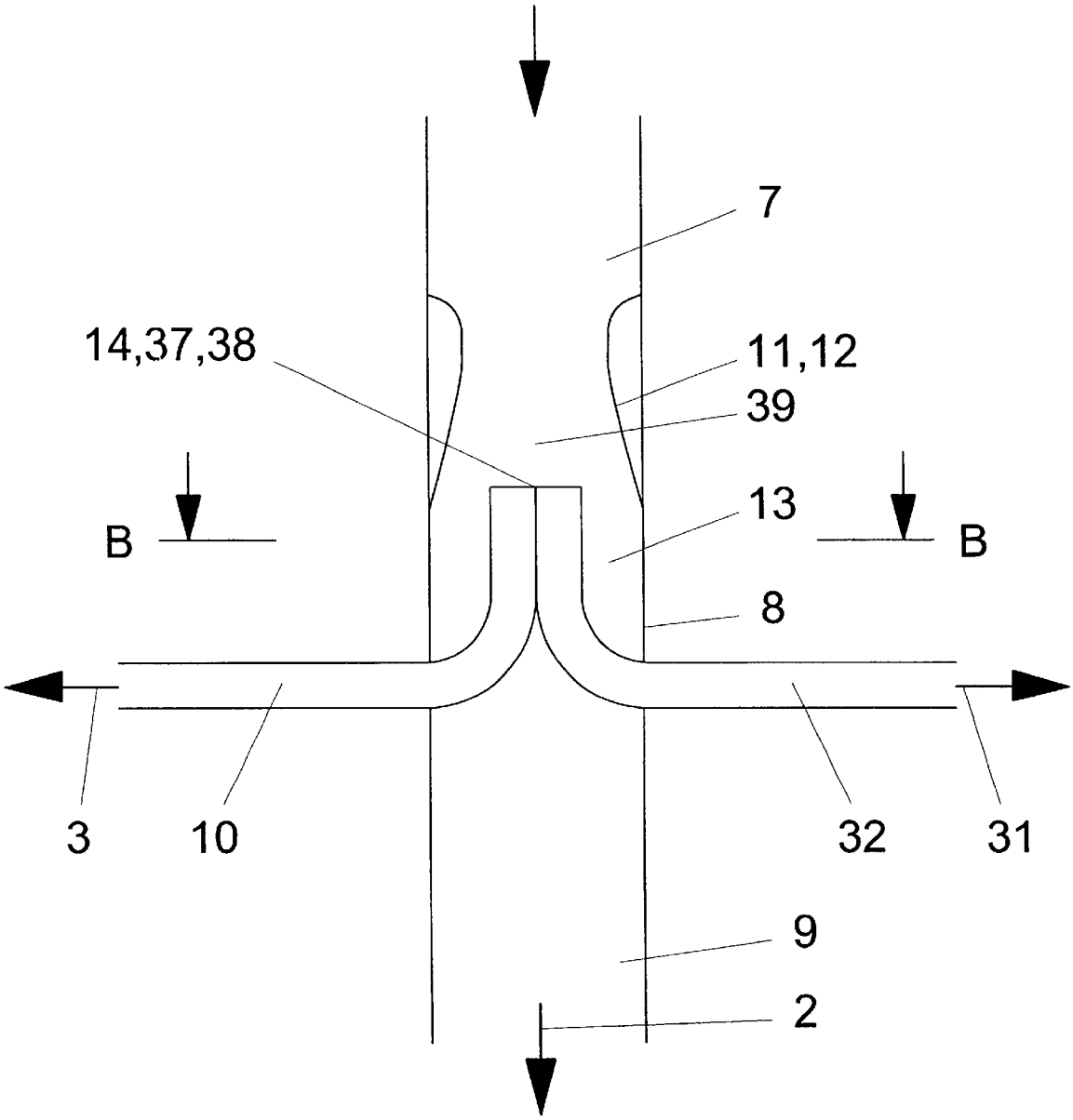
FIG. 5 is an enlarged schematic diagram of a second embodiment of a bypass having more than two pipe sections, according to Detail A of FIG. 1.
Figure 6:
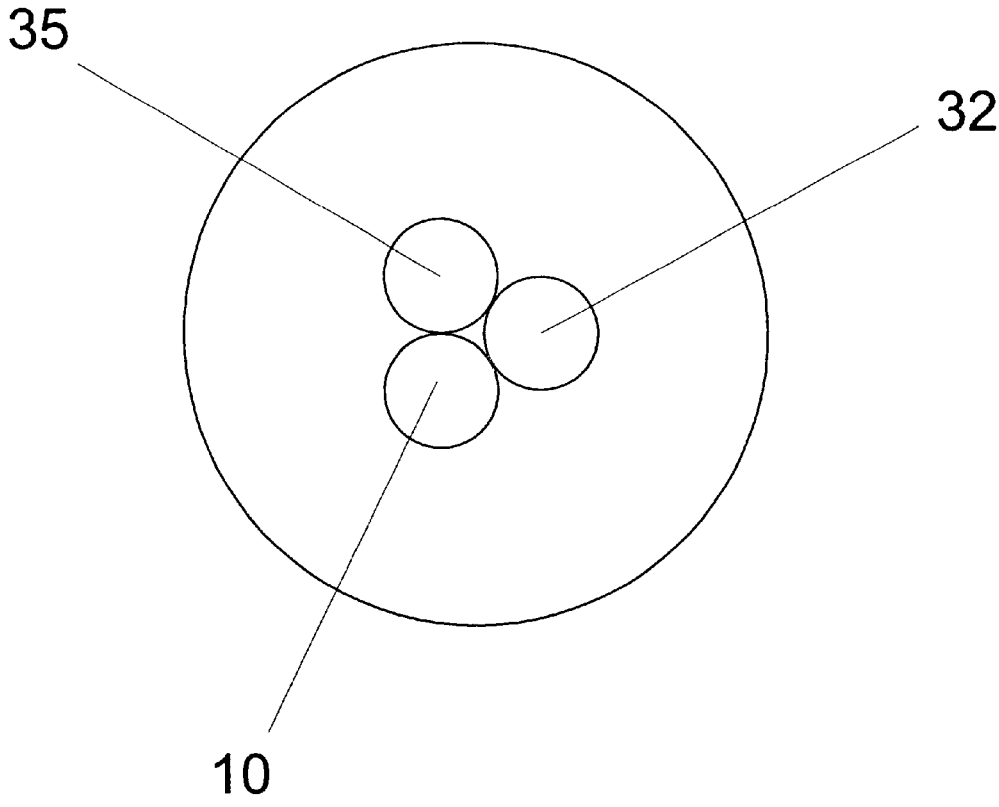
FIG. 6 is a cross-sectional view taken along line B—B of FIG. 5.

FIGS. 5 and 6 show that, instead of using a pipe section in the area of the venturi device 11, 12, it is possible to provide a number of different pipe sections 10, 32, 35 for a number of different circuits 3, 31, 34. This will increase the water flow in circuits 3, 31, 34. The inlet openings 14, 37, 38 of pipe sections 10, 32, 35 are also disposed in the vicinity of the diffuser 39 of the venturi device 11, 12 in such a way that the three inlet openings 14, 37, 38 all are located in the center of the descending pipe in order to achieve a uniform distribution of flow among the individual pipe sections 10, 32, 35. The pipe sections 10, 32, 35 each proceed essentially perpendicular to the descending pipe 7.

Figure 7:
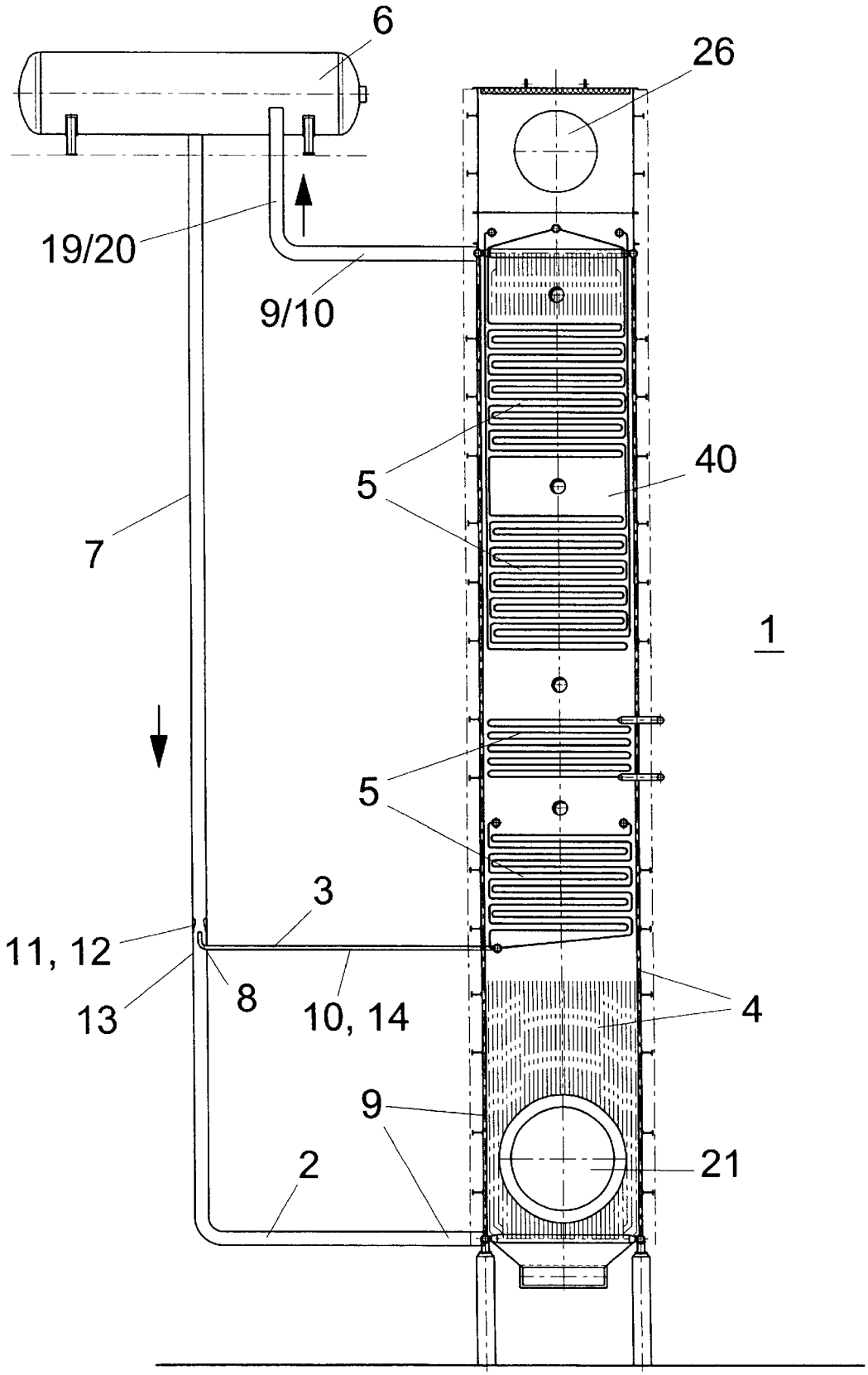
FIG. 7 is a schematic diagram in longitudinal cross-sectional view of a waste-heat steam generator in the form of a watertube boiler.

FIG. 7 shows an additional version of a steam generator 1 of the invention. The steam generator shown in FIG. 7 is also a waste-heat steam generator, but it does not use a firetube boiler, but rather a watertube boiler. The steam generator 1 has an essentially vertical gas stack 40, which is essentially comprised of water-cooled tubular walls and forms the evaporator 4 of the first water/steam circuit 2 of two existing circuits. The working medium, water, is fed from the drum 6 via the descending pipe 7 through the inlet opening 13 of pipe section 9 to the evaporator 4, where it is partially evaporated and then sent back to the drum 6 via pipe section 9.

The working medium of the second circuit 3 is transported at bypass 8 through the inlet opening 14 to pipe section 10 and thence to the evaporator 5, which are embodied as contact heating surfaces and are disposed in the gas stack 40. After partial evaporation of the water, the working medium returns to the drum 6 via pipe section 10. In the invention, the circulation of water in the second water/steam circuit 3 through the venturi device 11, 12 located at bypass 8 of descending pipe 7 is increased. The heating medium or hot exhaust gas passes through inlet 21 in the bottom of the gas stack 40 of the steam generator 1, and it flows through the gas stack 40 from the bottom to the top before it is sent to additional process steps at the outlet 26. When the heating medium flows through the gas stack, heat is transferred into the tubular walls and the contact heating surfaces-in other words into evaporator units 4 and 5.

If the apparatus of the invention is used in a mechanically circulated steam generator 1 (not shown), then the venturi device 11, 12 is advantageously located downstream from the circulating pump located in descending pipe 7. In a mechanically circulated system, descending pipe 7 is essentially a vacuum pipe upstream from the circulating pump and a pressure pipe downstream from the pump, just like the ascending pipe 19, 20. In the mechanically circulated design as well as in the gravity-convection design, the water circulation rate in the second circuit 3 is increased by means of the venturi device 11, 12.

As already discussed above, venturi nozzles or classical venturi pipes 12 such as those used to measure fluid flow rates in the case of DIN EN ISO 5167-1 restrictors, can be used. When viewed in the direction in which the fluid or water working medium flows, the venturi devices 11, 12 possess an inlet cone, a cylindrical necked section having an inside diameter of d (narrowest cross section), and a diffuser 39, and, instead of the inlet cone, an inlet curvature matching that of DIN EN ISO 5167-1 venturi nozzle is possible, and the neck section, which forms the narrowest cross section, may not be cylindrically shaped. The openings for measuring flow in the neck section may need to be eliminated. However, any other venturi device that deviates from this standard and that has a narrowed section and a diffuser part may be used. In order to ensure that there is an increased water circulation rate in the water/steam circuits 2, 3, 31, 34 in which an increased water circulation rate is desired, the ratio of the inside diameter d of the venturi device 11, 12 at its narrowest cross section to the inside diameter D of the descending pipe 7 may lie between 1.0 and 0.01.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A steam generator for converting water to steam by the transfer of heat from a heating medium, the steam generator comprising:

a plurality of water/steam circuits, each water/steam circuit including at least one evaporator adapted for transferring the heat from the heating medium to the water, each water/steam circuit also including a supply pipe adapted for supplying water to the at least one evaporator, each supply pipe defining an inlet opening;

a water/steam drum adapted for receiving steam or water and steam from the evaporator of each water/steam circuit;

a descending pipe adapted for delivering water from the water/steam drum to a lower end portion defining at least one bypass; and a venturi device disposed proximate to the bypass, the venturi device having a diffuser-shaped outlet;

wherein each supply line is in fluid communication with the bypass and the inlet opening of at least one inlet pipe is disposed proximate to the diffuser-shaped outlet of the venturi device, whereby the at least one inlet pipe defines a dynamic compression pipe, increasing the pressure of the water in the at least one inlet pipe.

2. The steam generator of claim 1, wherein the venturi device comprises a venturi nozzle disposed within the descending pipe.

3. The steam generator of claim 1, wherein the lower end portion of the descending pipe is configured as a venturi pipe.

4. The steam generator of claim 1, wherein the steam generator is operable in a gravity-convention mode.

5. The steam generator of claim 1, wherein the steam generator is operable in a mechanical-circulation mode.

6. The steam generator of claim 1, wherein the descending pipe has an inside diameter D and the venturi device defines a narrowing cross-section having an inside diameter d at the narrowest cross-section, the ratio of d to D being between 1.0 and 0.01.

* * * * *